United States Patent [19]

Little

[11] 4,413,735

[45] Nov. 8, 1983

[54] EDGE PROTECTOR AND METHOD OF MAKING EDGE PROTECTORS

[76] Inventor: Thomas J. Little, Kings Hill Rd., Etna, N.H. 03750

[21] Appl. No.: 256,137

[22] Filed: Apr. 21, 1981

[51] Int. Cl.[3] ..... B65D 81/02; B65D 85/30

[52] U.S. Cl. ..... 206/523; 206/586

[58] Field of Search ..... 206/523, 586, 453

[56] References Cited

U.S. PATENT DOCUMENTS

| | | | |
|---|---|---|---|
| 3,283,988 | 11/1966 | Hardigg | 206/523 |
| 3,530,213 | 9/1970 | Belle Isle | 206/523 |
| 3,769,741 | 11/1973 | Hessler | 206/523 |
| 3,854,650 | 12/1974 | Hanave | 206/523 |
| 3,994,433 | 11/1976 | Jenkins et al. | 206/523 |

*Primary Examiner*—Joseph Man-Fu Moy

*Attorney, Agent, or Firm*—Burns, Doane, Swecker & Mathis

[57] ABSTRACT

The present invention relates generally to edge protectors. More particularly, the present invention relates to a temporary protector for an edge of an article and a method of making edge protectors. In a preferred embodiment, the edge protector according to the present invention includes a first part having a scoring line. The scoring line extends from first to second edges of the first part and from a first side surface of the part substantially to a second side surface. A pliable film is applied to the second side surface of the first part for permitting flexing of the first part along the scoring line. A second part includes a recess in a first side surface sized to substantially encase a portion of the first part extending generally perpendicularly from the scoring line. The portion of the first part is secured within the recess in the second part. When it is desired to use the edge protector according to the present invention, the second part is preferably arranged upon a surface of the article to be protected with the portion of the first part not encased within the recess of the second part extending outwardly over the edge of the article to be protected. The extending portion of the first part is bent downwardly about the scoring line with the thin film acting as a hinge such that the extending portion lies substantially flush against a second surface of the article to protect the same.

13 Claims, 5 Drawing Figures

Fig. 1
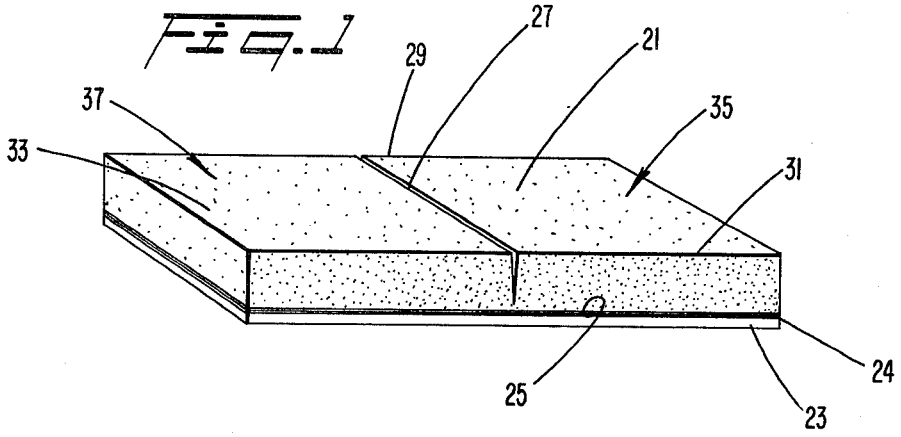
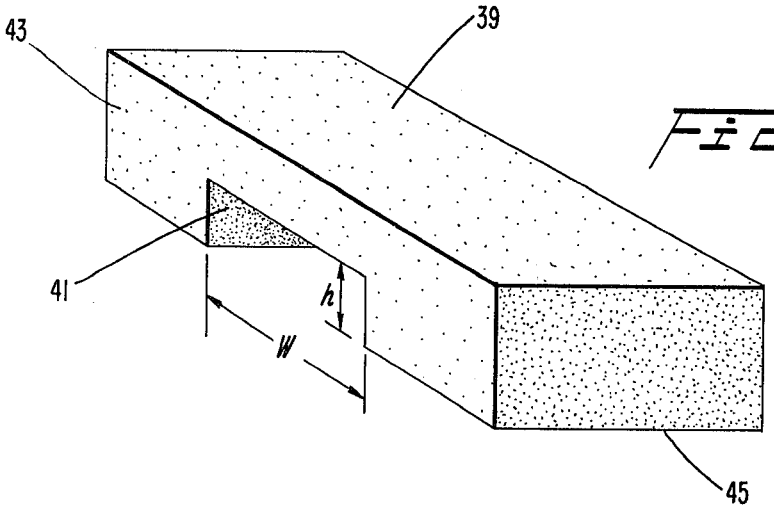
Fig. 2
Fig. 3
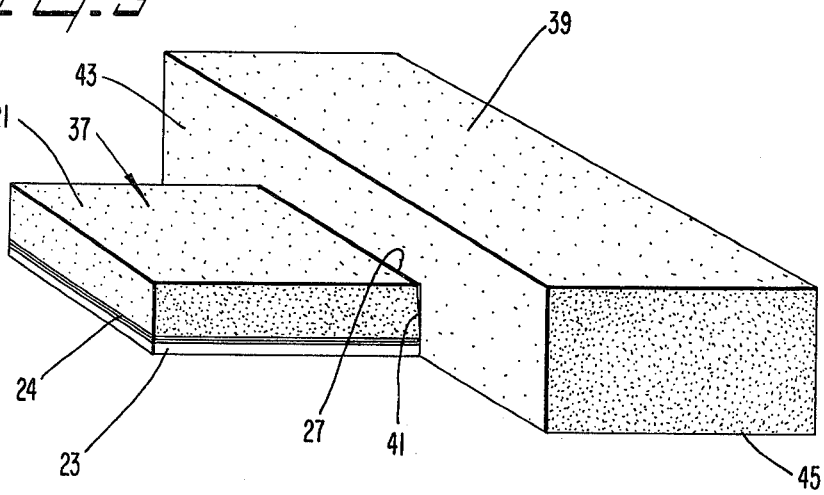

EDGE PROTECTOR AND METHOD OF MAKING EDGE PROTECTORS

BACKGROUND AND SUMMARY OF THE PRESENT INVENTION

The present invention relates generally to edge protectors. More particularly, the present invention relates to a temporary protector for an edge of an article and a method of making edge protectors.

When storing or transporting articles such as furniture, appliances and the like, it is desirable to provide a simple arrangement for protecting the edges of the articles from damage due to impacts. In particular, articles are often transported side-by-side and stacked upon one another to final packaging stages in an assembly line. During such movement, the articles must be protected from impacts both from horizontally and vertically adjacent articles. Simple angled foamed plastic sections have been proposed for such an arrangement. However, such simple foam plastic sections are often not sufficiently strong to support the weight of a second article, particularly an appliance, which is arranged on top of a first lower article without damage to the lower article.

Various packing or protective devices have been proposed. Often such devices are comprised of a single piece which is cut in a predetermined manner and subsequently folded into a desired shape. One such device includes a packaging spacer having a zig-zag configuration. The spacer has a longitudinal slit and a plurality of transverse slits perpendicular to the longitudinal slit. These slits enable the spacer to be bent to conform to the edge of an article that is to be shipped. A device of this type may be prone to complete breakage through the slits if the slits penetrate too deeply into the spacer material. Further, the relatively complex shape of the spacer may entail additional expense in manufacturing. A device of this type is disclosed in U.S. Pat. No. 3,314,584 issued Apr. 18, 1967 to Knapp et al.

A further proposed foamed plastic packing cushion comprises a flat cushion portion and a second portion hinged to the flat portion and adapted to be arranged at an angle of substantially 90° to the flat portion. The hinge is constructed by cutting or punching two non-parallel slits into the flat portion with a third slit cut partially through the flat portion. As the second portion (defined by the various slits) is bent upwardly, the edges of the non-parallel slits are compressed and then expanded to engage each other and hold the second portion in the position generally perpendicular to the flat portion. A device of this type can be constructed from only a single foamed plastic material. A device of this type is disclosed in U.S. Pat. No. 3,854,650 issued Dec. 17, 1974 to Hanaue.

Another proposed protector in the form of a corner pad includes a board like material such as cardboard which is cut in a predetermined shape. A felt pad is arranged on a first side surface of the board member. The board member is then folded in a certain manner such that the felt pad covers an entire inside surface of the finished corner pad. Such a device is relatively complex in shape and requires a complex folding sequence to obtain the finished corner pad. A device of this type is disclosed in U.S. Pat. No. 3,063,613 issued Nov. 13, 1962 to McClive.

A further corner packing device is comprised of a generally L-shaped section cut from sheet material. A pair of die cuts are arranged at the junctions of the "L" with portions of these junctions remaining to act as hinges. The two legs of the "L" are folded about the die cuts to form a corner piece which is locked in the finished position. A device of this type is disclosed in U.S. Pat. No. 3,482,759 issued Dec. 9, 1969 to Ortiz.

Numerous other packaging devices of various configurations have been proposed. For example, see U.S. Pat. Nos. 2,974,844 issued Mar. 14, 1961 to Lane; 3,161,339 issued Dec. 15, 1964 to Weller; 3,356,209 issued Dec. 5, 1967 to Pezely, Jr; and 4,162,729 issued July 31, 1979 to Kaiser et al.

It is an object of the present invention to provide a simple yet effective temporary protector for an edge of an article.

It is a further object of the present invention to provide an edge protector which is sufficiently strong to support a second article vertically above the article to be protected while providing adequate protection for a vertical side surface of the article. In other words, it is an object of the present invention to provide an edge protector which can be made of two different materials, one of which may be suitable for supporting a vertical load above the article to be protected.

Still a further object of the present invention is to provide an edge protector which has a configuration which facilitates shipping of the edge protectors. In addition, an edge protector according to the present invention can be simply formed to the desired shape to protect the edge of the article.

Additionally, it is an object of the present invention to provide an edge protector which is reliable and is not prone to breakage during use.

Another object of the present invention is to provide a method of making edge protectors which method is relatively simple and inexpensive.

These objects and many others are accomplished by an edge protector according to the present invention including a continuous first part or carrier body having a scoring line extending from first to second edges of the body and from a first side surface through the body to substantially a second side surface of the body. A film layer having dimensions sufficient to cover at least an area surrounding the scoring line and being sufficiently pliable to bend at least 90° without breaking is secured to the area of the second side surface of the body surrounding the scoring line. In the preferred embodiment, an adhesive is utilized to secure the film layer to the first part or carrier body with the film layer and adhesive being sufficiently pliable to permit bending of the body about the scoring line with the film layer acting as a hinge.

Still further in the preferred embodiment, a second part or support body includes a recess in a first side surface sized to substantially encase a portion of the first part extending generally perpendicularly from the scoring line. The first part is preferably secured within the recess in the second part such that the first side surface of the support body is generally coplanar with an exposed side surface of the film layer secured to the second side surface of the carrier body or first part.

In the preferred embodiment, the second part is of substantially denser material than the first part such that the second part is capable of withstanding substantially higher compressive loads than the first part. In an especially preferred embodiment, the first part is low density polystyrene and the second part is polystyrene of a higher density. Still further in the especially preferred embodiment, the thin film layer is polyethylene and is secured to the first part by an ethyl vinyl acetate adhesive. The first part may be secured within the recess in the second part, for example, by gluing, by press fitting, or by heat sealing, or RF sealing the first part to the second part.

According to a further aspect of the present invention, a method of making edge protectors includes the steps of forming a first generally parallelpipedic part. A thin pliable layer is secured to a first side surface of the first part and a scoring line is cut generally centrally within the first part with the scoring line extending from first to second edges of the first part and from a second side surface substantially to the first side surface. A second part is formed having a recess sized to receive a portion of the first part extending generally perpendicularly from the scoring line. The first part is secured within the recess in the second part.

In a preferred embodiment, a plurality of first parts are formed from a single large sheet of material. The large sheet is cut into the desired shape for the individual first parts. The second part, due to its configuration and higher density, is preferably individually molded.

In use of the edge protector according to the present invention, the second part or support body is arranged on a surface of the article to be protected with the scoring line in the first part arranged generally parallel with an edge of the article. A portion of the first part extending outwardly from the edge is then bent to an angle of substantially 90° with respect to the portion of the first part secured within the support body. After bending, the extending portion protects a side surface generally perpendicular to the surface upon which the support body rests. In this way, the edge protector according to the present invention is positioned to protect the article from impacts directed against either of the two surfaces.

BRIEF DESCRIPTION OF THE DRAWINGS

Preferred embodiments of the present invention will be described in greater detail with reference to the accompanying drawings wherein like members bear like reference numerals and wherein:

FIG. 1 is a perspective view of a first part or carrier body of an edge protector according to the present invention;

FIG. 2 is a perspective view of a second part or support body of the edge protector according to the present invention;

FIG. 3 is a perspective view of an assembled edge protector according to the present invention;

DETAILED DESCRIPTION OF THE PREFERRED EMBODIMENTS

Figure 4:
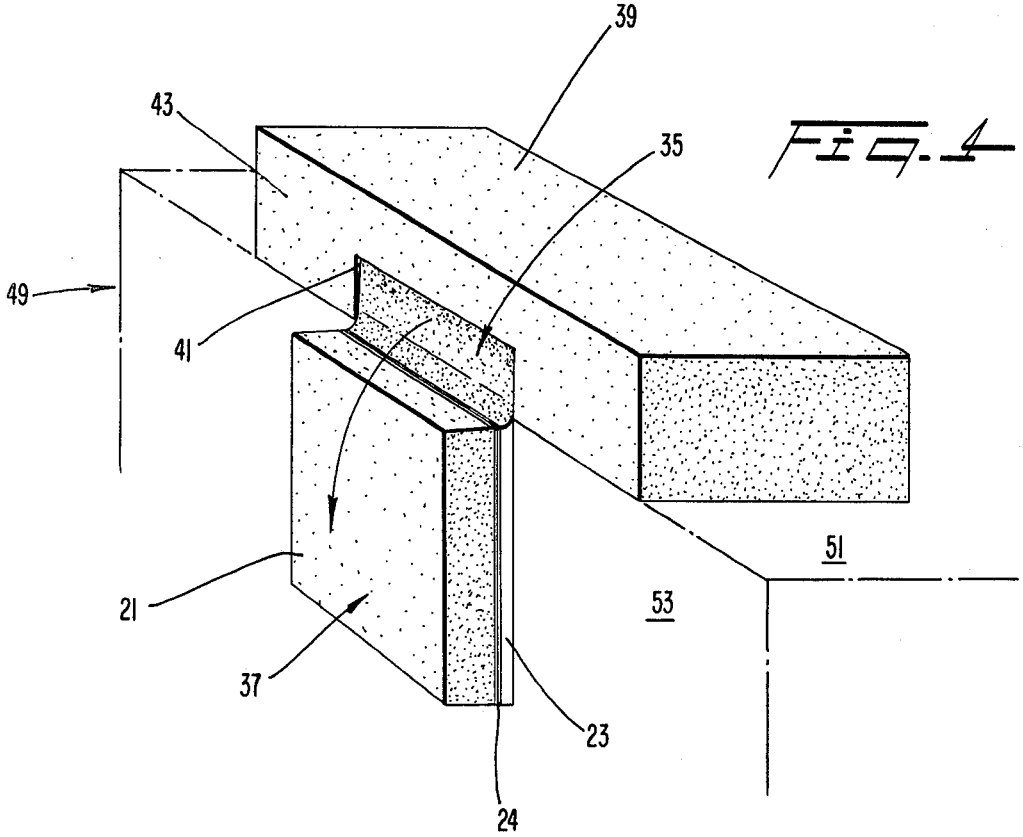
FIG. 4 is a perspective view of the edge protector according to the present invention arranged in protecting relationship with an article to be protected.

With reference to FIG. 1, an edge protector according to the present invention includes a carrier body or first part 21 formed of any suitable shock absorbing material. Typical shock absorbing materials include wood, pressboard, cardboard, unfoamed plastic and preferably a foamed plastic such as polyurethane or polystyrene having a density of from about 0.5 to about 2.0 pounds per cubic foot. In an especially preferred embodiment, the first part 21 is formed of polystyrene foam having a density of approximately 1 pound per cubic foot.

The first part 21 includes a thin film or layer 23 secured to a first side surface 25 of the first part 21. The film 23 is comprised of a material which is sufficiently pliable to be bent substantially 90° without risk of cracking or breaking the film 23. In other words, the film must be thin enough to bend easily and thick enough to resist breakage during bending. Thus, for example, the film may be from about 1 to about 4 mils thick and may be comprised of a nylon, a vinyl polymer or an olefin polymer. In an especially preferred embodiment, the film 23 is comprised of polyethylene having a thickness of approximately 2 mils. As noted above, the layer 23 may be comprised of any material capable of bending substantially 90° without a reasonable likelihood of breaking or cracking. Further, the material of the film is preferably not sufficiently resilient to "spring back" to an aligned position after being bent substantially 90°.

The film layer 23 is preferably secured to the first part or carrier body 21 by any suitable means such as heat sealing or by employing an adhesive 24 which does not interfere with or reduce the pliable nature of the film 23 or adversely affect the body or the film material. In an especially preferred embodiment, when using a polyethylene film layer, ethyl vinyl acetate (EVA) has been found to be a suitable adhesive. Any other suitable adhesive may be used which does not form a rigid structure which would inhibit the bending of the film layer 23. The adhesive may be different for different carrier body and/or film materials.

A scoring line 27 is provided in the first part 21 to permit bending of the first part about the scoring line 27 with the film layer 23 acting as a form of hinge. The scoring line 27 extends from a first edge 29 to a second edge 31 of the first part 21. The scoring line 27 also extends from a second side surface 33 substantially to the first side surface 25 of the first part 21. In other words, the scoring line 27 substantially divides the first part 21 into first and second portions 35 and 37, respectively. It is noted that while the scoring line 27 is illustrated in about a mid-section of the first part 21, it may be provided at any desired location.

It is preferred that the scoring line 27 be provided in the first part after securing the film layer 23 thereto with a suitable adhesive to prevent the portions 35 and 37 from separating. As illustrated in FIG. 1, the scoring line is shown in exaggerated scale for clarity. It will be recognized that the scoring line 27 in actual practice is a very narrow incision within the first part 21 formed by, for example, a hot wire. Once the film is in place, it will be appreciated that even if the scoring line 27 inadvertently extends entirely through the first part 21, the portions 35 and 37 will not separate due to the continuous film layer 23.

It should be noted that the film layer 23 need not cover the entire first side surface 25 of the first part 21. It would be sufficient to cover an area surrounding the scoring line 27 such that the film layer 23 could act as an appropriate hinge. However, the film layer 23 may provide further protection for the article and, in the especially preferred embodiment with a polyethylene film layer, may provide a somewhat "sticky" surface due to its relatively high coefficient of friction which aids in preventing sliding of the edge protector along the article to be protected. Of course, it should be noted that dependent on the materials of construction, the article to be protected and the expected stress to which the article is to be subjected, it may be necessary to tape the edge protector to the article to be protected in order to ensure that the first part 21 does not slide off of the article.

The first part 21 may be used as an edge protector by arranging the film layer 23 of the first part 21 on a surface of an article to be protected with the scoring line 27 substantially coinciding with the edge of the article. In other words, one portion, for example, the portion 35 of the first part 21 is arranged on the article while the other portion 37 extends outwardly from the edge of the article. The portion 37 is then bent downwardly substantially 90° about the scoring line 27 with the film layer 23 acting as a hinge until the portion of the film layer 23 contacts the side surface of the article to be protected.

With reference to FIG. 2, a second part or support body 39 is preferably provided for holding the first part and for providing additional protection for the article. In a preferred embodiment, the second part 39 comprises a generally parallel-epipedic block. The support body 39 may be constructed of the same or a different material than the first part and preferably is constructed of a material which is substantially denser than the material from which the first part 21 is formed. In other words, the support block 39 preferably is capable of absorbing greater impacts and withstanding higher compressive loads than the first part 21 and typically has a density ranging from about 1.0 to about 10.0 pounds per cubic foot. This may be accomplished by selecting a different material among those described with respect to the first part or by selecting a different density of the same material.

A lower side surface 45 of the second part 39 is provided with a recess 41 which is sized to substantially encase one portion 35 of the first part 21 in such a way that the scoring line 27 is arranged generally parallel with a front side surface 43 of the support body 39 (FIG. 3). The recess 41 preferably extends only partially through the support body 39 to maintain the desired strength of the support body 39. Further, the height h of the recess 41 is arranged such that when the first part 21 is arranged within the recess 41, the exposed surface of the film layer 23 is substantially coplanar with the lower side surface 45 of the support body 39. The support body 39 may be provided with a plastic film or layer (not shown) along the upper surface 39, the lower surface 45 or both to improve adhesion of the support body 39 with the container, the surface of the article to be protected or both and thus aid in maintaining the protector in place. If the plastic layer is provided on the second part 39, the height h of the recess 41 is decreased to maintain the lowest surface of the first and second parts coplanar.

With further reference to FIG. 3, the first part 21 is arranged within the second part 39 and is preferably secured within the recess 41 by any suitable arrangement. The first part 21 may be easily secured in the recess 41 of the second part 39 by gluing with a suitable adhesive. Alternatively, the first part 21 may be secured in the recess 41 by heat sealing or by RF sealing the parts together provided that the two parts are made of suitable plastic materials that melt upon local application of heat or RF energy. Further, the portion 35 of the first part 21 may be press fit within the recess 41 if desired. The press fit could be accomplished by tapering the inner walls of the recess 41 toward one another such that the edge surfaces of the portion 35 would be compressed as the portion 35 is slid inwardly into the recess 41 or by tapering the inner walls and correspondingly cutting the walls of the first part such that it can be slid and held by friction. Alternatively, the size of the recess could be just slightly smaller than the size of the portion 35 such that the first part 21 would be pressed or forced within the recess 41.

In an especially preferred embodiment, the support body 39 is made of polystyrene having a density of approximately 2 pounds per cubic foot. As explained above, the support body 39 could also be made of wood or any other suitable material which is resistant to compressive loads. The support body 39 is provided in particular to permit vertical stacking of articles to be protected. In other words, due to the higher compressive loads to which the support body 39 can be subjected without fracture, a second article may be arranged vertically above the first article resting upon the support body 39 without damaging the first, lower article. This arrangement is particularly important during storage or in final manufacturing stages when articles, particularly appliances, are arranged vertically above one another to be transported to further packaging stations.

In the preferred embodiment, in order to ensure retention of the increased strength of the support body 39, the width w of the recess 41 does not exceed approximately one half of the overall length of the front side surface 43. In this way, sufficient area of contact between the lower side surface 45 of the support body 39 and the article to be protected is maintained in order to prevent collapse of the support body 39 resulting in damage to the article to be protected. Also, to further retain the strength characteristics of the support body 39, the height h of the recess 41 preferably does not exceed approximate one half of the height of the front side surface 43 of the support body 39.

With reference to FIG. 4, the assembled edge protector according to the present invention is shown arranged upon an article 49 (shown in phanton lines) such as an appliance or a piece of furniture. As can be seen, the support body 39 rests squarely upon an upper surface 51 of the article. The second portion 37 of the first part 21 has been bent downwardly until contacting a side surface 53 of the article being protected. It should again be noted that the portion 37 does not tend to separate from the remainder of the first part 21 (portion 35) due to the flexibility of the continuous film layer 23.

In the operative position (FIG. 4), the edge protector according to the present invention provides protection in both a vertical and a horizontal direction. Since the support body 39 is arranged on the upper, horizontal surface 51 of the article 49, a second article can be arranged vertically above the first article 49 with the compressive load being absorbed by the support body 39. Of course, if a greater degree of protection from lateral loads is required, support body 39 may be arranged accordingly. It should be noted that an edge protector is preferably arranged along each edge of the article to afford complete protection and to provide sufficient support for a second article. It may also be desirable to secure the edge protectors to the article, for example, by tape.

It should be noted that by producing an edge protector in separate parts as in the present invention, an edge protector which is capable of withstanding substantially higher loads in one direction than in another direction can be obtained at a relatively low cost. By utilizing a less dense, less expensive material for the first part 21, a substantial expense is saved over that which would be incurred if the entire edge protector were comprised of the denser, more expensive material of the support body 39.

Further, the edge protector according to the present invention can be adapted to any particular requirements of the user. For example, the support body for one user requiring a high compressive strength may be formed separately from the support body for a second user who does not require such high compressive resistance. The support body 39 and the first part 21 can each be made of any desired material specifically adapted for the ultimate use of the edge protector. The dimensions of the overall edge protector may also be readily changed according to the desired use. For example, the support body 39 may be between approximately ¾ to 2 inches in height, approximately 3 to 6 inches in width, and approximately 15 to 48 inches in length. The first part 21 can be similarly produced in various different sizes according to the desired application. The height of the first part 21 is preferably no greater than one half the height of the support body 39 and the length of the scoring line 27, i.e., the width of the first part 21, is preferably less than one half of the overall length of the support body 39 in order to ensure that the support body 39 can maintain the desired compressive strength.

Figure 5:
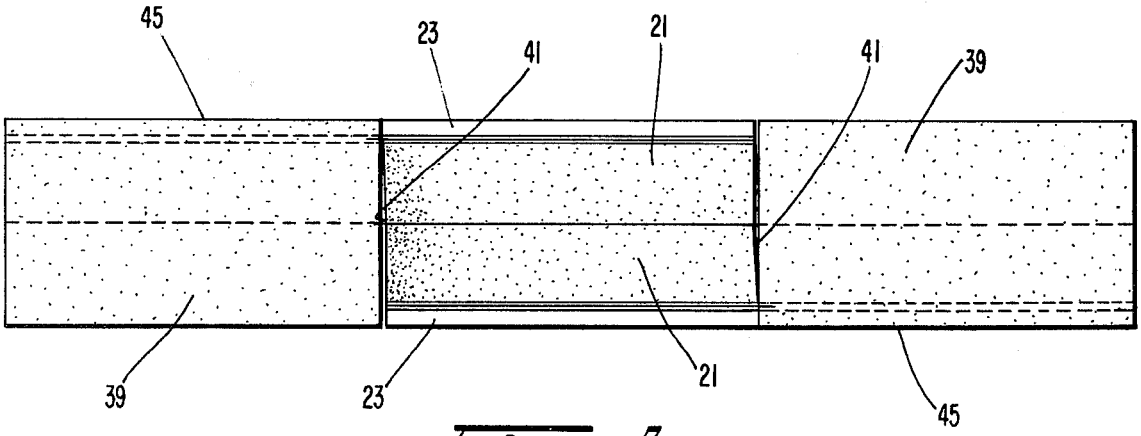
FIG. 5 is a side view of two edge protectors according to the present invention arranged in overlapping relationship for shipping.

With reference to FIG. 5, in a further aspect of the present invention, the assembled edge protectors can be easily stacked for shipping to the ultimate user. The first parts 21 of a pair of edge protectors may be overlapped such that the total area required for the two edge protectors is minimized. This is possible due to the fact that the edge protectors when assembled and prior to actual use contain no perpendicularly extending portions. The second portion 37 of the first part is not bent to an angle of substantially 90° with respect to the first portion 35 until the edge protector is arranged upon the article to be protected.

The edge protector according to the present invention can be manufactured by a small number of relatively simple process steps. In a preferred embodiment of the manufacturing process, a large sheet of suitable material, for example low density polystyrene, can be produced by known methods for forming a plurality of first parts 21. The large sheet is then preferably coated with the film layer 23 which is secured by a suitable adhesive 24. The coated large sheet is then cut into individual first parts. The cutting may be accomplished by any suitable method depending upon the material from which the sheet is made. If polystyrene is employed, a hot wire is effective to cut the sheet. The scoring lines 27 may be cut into each of the first parts 21 when the first parts are in the large sheet or after cutting the sheet into individual first parts 21. It should be noted that since the scoring line 27 is a simple straight line, only a single cutting operation is required.

The second part or support body 39 is preferably formed individually due to the higher density required of the support body 39. Each of the support bodies 39 including the recess 41 is preferably formed in an individual molding or forming operation if the body 39 is polystyrene. Other suitable processes are contemplated for different support body materials.

The first part 21 is then secured within the recess 41 of the support body 39 by the selected method. The first part 21 may be joined to the second part 39 by gluing, heat sealing, RF sealing, press fitting or any other suitable process. The edge protector according to the present invention is thus fully assembled. When it is desired to use the edge protector, the support body 39 is arranged on the article to be protected and the portion 37 of the first part 21 is bent downwardly about the scoring line 27.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A protector for an edge of an article comprising:

a first part having a scoring line, said scoring line extending from a first edge to a second edge of the first part and from a first side surface of the part closely adjacent to a second side surface;

pliable film means on the second side surface of said first part for permitting flexing of said first part along said scoring line;

a second part having a recess in a first side surface which encases a portion of the first part extending from the scoring line; and means for securing the portion of the first part within the recess in the second part.

2. The protector of claim 1, wherein an exposed surface of the pliable film is substantially coplanar with the first side surface of the second part when the portion of the first part is secured within the recess.

3. The protector of claim 1, wherein the pliable film means is secured to the first part by an adhesive which does not interfere with the pliable nature of the film means.

4. The protector of claim 3, wherein the pliable film means is polyethylene and the adhesive is ethyl vinyl acetate.

5. The protector of claim 1, wherein the width of the recess is less than one half of the total length of the second part in a direction parallel with the scoring line.

6. The protector of claim 1, wherein the height of the recess is less than one half of the total height of the second part.

7. The protector of claim 1, wherein the second part is of substantially denser material than the first part.

8. The protector of claim 1 or 7, wherein the first part is low density polystyrene and the second part is high density polystyrene.

9. The protector of claim 1, wherein the first part is secured to the second part by an adhesive.

10. The protector of claim 1, wherein the first part is press-fit into the recess in the second part.

11. The protector of claim 1, wherein the first part is secured to the second part by heat sealing or RF sealing.

12. An edge protector comprising:

a carrier body including a scoring line extending from first to second edges of the body and from a first side surface through the body to substantially a second side surface of the body;

a film layer having dimensions sufficient to cover at least an area surrounding the scoring line and being sufficiently pliable to bend at least 90° without breaking;

adhesive means for securing the film layer to the area of the second side surface of the body surrounding the scoring line, said adhesive means being sufficiently pliable to permit at least 90° bending of the body about the scoring line with the film layer acting as a hinge; and a support body having a recess in a first side surface sized to receive a portion of the carrier body extending from one side of the scoring line, and means for securing said carrier body portion in said recess such that the first side surface of the support body is generally coplanar with an exposed side surface of the film layer secured to the second side of the carrier body.

13. A protector for an edge of an article comprising:

a first part having a scoring line, said scoring line effectively separating said first part into first and second portions, said scoring line extending from a first edge to a second edge of the first part and from a first side surface of the part closely adjacent to a second side surface, such that said first portion may be moved to a position substantially perpendicular to the second portion without complete separation of the first and second portions;

a second part having a recess in a first side surface, said recess receiving at least a portion of the second portion of the first part; and means for securing the second portion of the first part within the recess in the second part.

* * * * *